US007260921B2

(12) United States Patent
Stemmle

(10) Patent No.: US 7,260,921 B2
(45) Date of Patent: Aug. 28, 2007

(54) METHOD AND APPARATUS FOR ENVELOPING DOCUMENTS

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 980 days.

(21) Appl. No.: 10/320,105

(22) Filed: Dec. 16, 2002

(65) Prior Publication Data

US 2004/0114161 A1 Jun. 17, 2004

(51) Int. Cl.
*B65B 11/48* (2006.01)
*B65B 61/02* (2006.01)

(52) U.S. Cl. ..... 53/460; 53/411; 53/429; 53/569; 53/206; 493/442

(58) Field of Classification Search ..... 53/411, 53/429, 460, 116, 117, 131.4, 284.3, 206, 53/569; 493/419, 420, 442, 444
See application file for complete search history.

(56) References Cited

U.S. PATENT DOCUMENTS 3,557,519 A 1/1971 Lyon
3,845,698 A 11/1974 Scholle
3,902,655 A 9/1975 Huffman
3,998,138 A 12/1976 Walters
4,067,171 A 1/1978 Herbert et al.
4,071,997 A * 2/1978 Gunther et al. ..... 53/429
4,161,091 A 7/1979 Hartnig
4,437,852 A 3/1984 Volk, Jr. et al.
4,543,082 A 9/1985 Stenner
4,651,920 A 3/1987 Stenner
4,733,856 A * 3/1988 Gunther, Jr. ..... 53/284.3
4,912,909 A 4/1990 Stenner
5,067,305 A * 11/1991 Baker et al. ..... 53/460
5,169,060 A 12/1992 Tighe et al.
5,340,017 A 8/1994 Tighe
5,501,392 A 3/1996 Kraus ..... 229/92.3
5,527,418 A 6/1996 Ginsberg ..... 156/443
5,543,202 A 8/1996 Clark et al. ..... 428/154
5,638,666 A 6/1997 Davidov ..... 53/569

(Continued)

FOREIGN PATENT DOCUMENTS

DE 3928501 7/1991

(Continued)

OTHER PUBLICATIONS

U.S. Appl. No. 10/177,590, filed Jun. 20, 2002 entitled, "Enclosure Apparatus and Method of Fabrication Therefor" by Denis J. Stemmle.

*Primary Examiner*—Louis Huynh
(74) *Attorney, Agent, or Firm*—Michael J. Cummings; Angelo N. Chaclas

(57) ABSTRACT

An enclosure is formed from a single sheet of paper, which is of a standard size. The sheet of paper is folded along the short edges and then folded along a mid-section. Content material may be placed on the sheet of paper or printed information can be printed on desired surfaces of the paper. The paper may also be folded so that a fold-over flap is formed. The edges are attached through a sealing mechanism such as knurling, gluing, embossing or crimping, tabbing, stapling.

37 Claims, 9 Drawing Sheets

U.S. PATENT DOCUMENTS

| | | | | |
|---|---|---|---|---|
| 5,641,115 | A | 6/1997 | Brewster | 229/92.8 |
| 5,785,242 | A | 7/1998 | Lombardo | 229/305 |
| 5,904,030 | A | 5/1999 | Kavanagh | 53/460 |
| 5,997,457 | A | 12/1999 | Stenner | |
| 6,019,280 | A | 2/2000 | Peterson | 229/305 |
| 6,039,242 | A | 3/2000 | Tee | 229/92.1 |
| 6,073,421 | A | 6/2000 | Lee | 53/206 |
| 6,080,259 | A | 6/2000 | Nadeau et al. | 156/227 |
| 6,109,440 | A | 8/2000 | Cliff | 206/523 |
| 6,123,253 | A | 9/2000 | Mehta et al. | 229/92.1 |
| 6,129,389 | A | 10/2000 | Younger | 283/116 |
| 6,132,554 | A | 10/2000 | Traise et al. | 156/442.1 |
| 6,152,361 | A | 11/2000 | Abercombie et al. | 229/305 |
| 6,179,201 | B1 | 1/2001 | Chess | 229/92.1 |
| 6,207,257 | B1 | 3/2001 | Cummings | 428/195 |
| 6,276,601 | B1 | 8/2001 | Ross et al. | 229/305 |
| 6,592,022 | B1 * | 7/2003 | Kamoi | 53/460 |

FOREIGN PATENT DOCUMENTS

| | | |
|---|---|---|
| SE | 9803525-6 | 5/2000 |
| SE | 9803526-4 | 5/2000 |
| WO | WO96/26599 | 8/1996 |
| WO | WO 02/45975 | 6/2002 |

* cited by examiner

METHOD AND APPARATUS FOR ENVELOPING DOCUMENTS

BACKGROUND OF THE INVENTION

1. Field of the Invention

This invention relates generally to a method and apparatus for fabricating an enclosure. The enclosure may have information printed on surfaces of the enclosure and further may be used to enclose additional content material. More particularly, this invention relates to a method and apparatus for fabricating an enclosure from a single sheet of material. The sheet of material may be rotated and folded in a particular fashion to form the enclosure, which may be sealed. Also, the sheet of material may be rotated and folded to enclose the additional content material and then sealed at selected areas to maintain the integrity of the enclosure.

2. Background Art

Conventional envelopes contain mail content material and typically require specialized mailing products, such as a number 3 envelope, number 10 envelope, a business reply envelope (BRE) and similar especially—manufactured materials. These materials are adapted to receive content material, such as letters, bills, and other information to be sent to a recipient. When using conventional envelopes, it is necessary to insert the content material into the envelope prior to sealing the envelope.

For high volumes of mail pieces for which it is undesirable to assemble the mail pieces manually, conventional insertion processes may be difficult to perform without sophisticated equipment, since the desired content material must be associated with a corresponding envelope. In the event content material becomes disassociated from a corresponding envelope, corrective action must be taken to mitigate delivery of incorrect material to a recipient.

Conventional "self-mailers" typically require especially manufactured paper or other material. One example of a self-mailer is the One Step Mailer from GBR Systems Corporation, Chester Research Park, Chester, Conn. The GBR mailers have glue beads dispensed on two sides of the self-mailer and glue dots are applied across the top portion. One disadvantage to this self-mailer is that it requires specific and expensive material that must be fed into a printer device and mail assembly equipment.

Another conventional mail envelope is available from Nexti AB, which utilizes different sized sheets of paper material as front and back covers, respectively, to form an envelope. One disadvantage to the Nexti envelope is that it requires over-sized sheets to be used to form the envelopes. Such oversized sheets are not commonly available, and must be specially ordered. Thus, the over-sized sheet must be inserted in a desired location so that it will be in the correct sequence to form the enclosure.

Other examples of conventional mailing envelopes and methods therefor include U.S. Pat. No. 5,501,392, entitled, "Folded Single Sheet Mailer", which relates to a folded single sheet mailer that comprises a rectangular sheet provided with transverse and longitudinal lines of perforation and transverse and longitudinal glue lines. The sheet is folded onto itself along a transverse fold line, which is offset with respect to the center of the sheet. The sheet is then folded along a plurality of secondary fold lines and sealed to produce an outgoing envelope that can be mailed. The mailer includes a return envelope for use when placing an order. One drawback to this mailer is that it requires specifically manufactured paper to produce the mailer.

U.S. Pat. No. 5,638,666, entitled, "Desk-Top Envelope Maker" relates to an apparatus and method for making an envelope from ordinary size, readily available, writing paper. The apparatus is a desk-top size machine that can be combined with an office printer, such as a laser printer, or incorporated therein to form a single machine. The apparatus enables integration of office computerized printing of letters and addressing of envelopes, by using a single paper tray. Following the printing of a letter, the subsequently fed final sheet of paper from the paper tray is routed to the envelope making apparatus, perhaps after the printing of an address on the final sheet, whereby an envelope is created. Ordinary size paper is fed into the apparatus from a tray. When the paper enters the machine, two impression lines or creases are made along the length of paper, which will subsequently serve as fold lines. These impressions are made by sharp rollers preferably mounted at the infeed to the machine so that the rollers press against the paper while the paper is fed into the apparatus. This apparatus and method has the drawback that it requires cutting and gluing to form an envelope. Secondly, it results in scrap being produced, which must be disposed of.

U.S. Pat. No. 6,019,280, entitled, "C-Fold Return Postcard Mailer" relates to a mailer type business form intermediate, and business form produced from the intermediate, that have an included postcard which is used as a reply piece. The mailer may be a C-fold mailer, with a window (e.g. die cut-out) formed in one of the panels, which overlies the outgoing address indicia formed on a face at the postcard. Check-off indicia is provided on the postcard to optimize response, and tear-off strips along the side edges of the mailer are held together with pressure sensitive cohesive. Tacking pressure sensitive adhesive may also be provided along edges of the die cut-out panel and the postcard-securing panel, exterior of the postcard.

Therefore, what is needed to overcome the present disadvantages and drawbacks of the current state of the art is a mailer that can be fabricated from a standard size sheet material and does not require special materials.

BRIEF SUMMARY OF THE INVENTION

In order to overcome the aforementioned drawbacks of the prior art, the instant invention utilizes a standard sheet to form an enclosure.

Accordingly, one embodiment of the present invention relates to a method for fabricating an enclosure. The method includes providing a first sheet of material from a plurality of sheets of material that are positioned in a pre-determined orientation. The direction of the first sheet of material is varied a pre-determined magnitude. The first sheet of material is creased along two-short edges of the first sheet. Content material is generated, compiled and folded at a pre-determined area. Content material is positioned on the first sheet. The content material and the first sheet are folded at a pre-determined location so that two opposing long edges of the first sheet make contact. A portion of the first sheet is sealed along the two opposing long edges of the first sheet; and/or along the short edges of the first sheet. Furthermore, information such as indicia data, recipient address data, sender address data and slogan information may optionally be printed on the first sheet.

Another embodiment is that the enclosure can be fabricated prior to printing indicia data and recipient address data. Also, the sheet material can be folded in half prior to the content material being placed on the sheet material.

Yet another embodiment of the present invention relates to an apparatus for fabricating an enclosure. The apparatus includes, a roller that contacts a first sheet of material from a source of material and changes the direction of travel of the first sheet of material. A creasing roller creases the first sheet of material along two short-edges of the first sheet of material. Content material is generated and compiled. First fold rollers that fold the content material and; fold assist arms are employed to guide the first sheet and the content material into a second set of fold rollers. Second fold rollers fold the first sheet and the content material and one or more sealing rollers seal a portion of the first sheet to form an enclosure.

Yet another embodiment of the present invention relates to a method for fabricating an enclosure that includes feeding a first sheet of material along a predetermined path; and modifying the orientation of the first sheet of material. One or more additional sheets of content material are compiled in a pre-determined manner and folded. The first sheet is creased along a first edge and a second edge. The content material is positioned over an area of the first sheet of material. The first sheet is folded at a mid-point area and two or more areas of the first sheet are attached. This attaching is typically performed by sealing, gluing, crimping, knurling, embossing, using a pressure sensitive adhesive, or using a hot-melt compound.

Yet another embodiment of the present invention relates to a method for fabricating an enclosure. The method includes providing a plurality of similar-sized sheets; and feeding a selected first sheet along a predetermined path. The selected first sheet is inverted at a predetermined magnitude and creased at a first area of the sheet and a second area of the sheet. A set of sheets having content data are assembled. Pre-printed documents may be inserted into the set of sheets to form a bundle. The bundle is folded at a pre-selected location and positioned on the first sheet. The first sheet is folded to form an enclosure and at least one portion of the enclosure is sealed.

Yet another embodiment of the present invention relates to a method for fabricating an enclosure. The method includes providing a first sheet of material from a plurality of sheets of material, which are positioned in a pre-determined orientation. The direction of the first sheet of material is modified a pre-determined magnitude. The first sheet of material is folded along two-short edges of the first sheet and folded at a pre-determined location so that two opposing long edges of the first sheet make contact. At least one portion of the first sheet is sealed along the two opposing long edges of the first sheet.

BRIEF DESCRIPTION OF THE DRAWINGS

Generally.

FIG. 1 shows feeding a sheet material to a roller.

FIG. 2 shows changing the direction of the sheet material.

FIG. 3 shows creasing the short edges of the sheet material.

FIG. 4 shows compiling content material.

FIG. 5 shows folding the content material.

FIG. 6 shows positioning the content material on the sheet material.

FIGS. 7 and 8 show folding the content material and the sheet material.

FIG. 9 shows sealing an enclosure.

DETAILED DESCRIPTION

Figure 1:
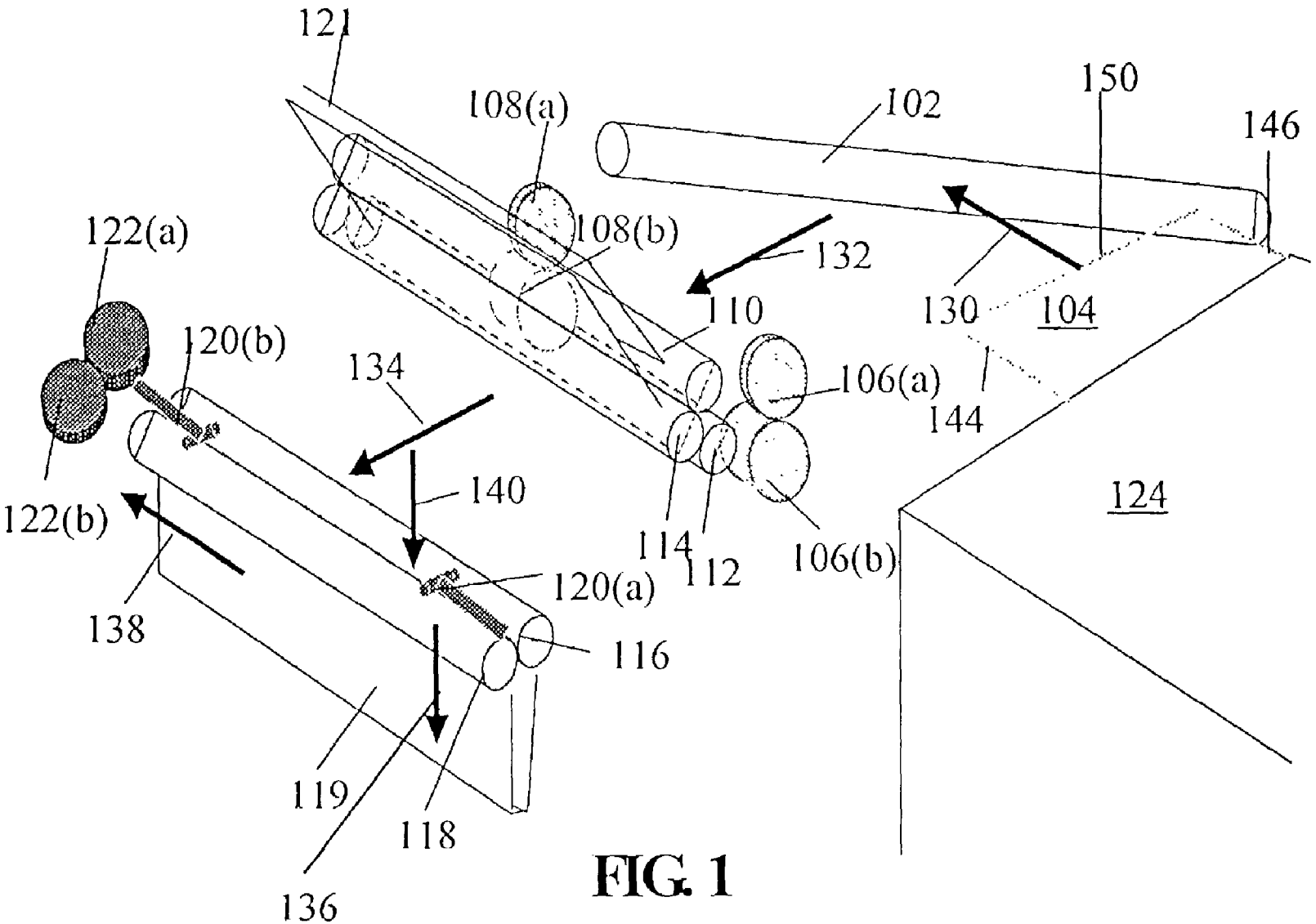
FIGS. 1–9 show an apparatus and process to form an enclosure according to the present invention.

The present invention overcomes the problem that arises when inserting content material into enclosures such as envelopes. It is very difficult for an automated apparatus to complete the steps of envelope feeding, flap opening, content inserting, moistening, flap closing, and sealing of the envelope with acceptably low failure rates. It is also difficult to process envelopes that have been imprinted using laser printers since the envelopes may become warped and/or distorted during the printing process. Furthermore, oftentimes, the flap of an envelope will inadvertently seal prior to content insertion. It is apparent that the envelope, which is typically of a different size dimension of the content material must be involved in an inserter system to enable insertion of content mail into the envelope. Tolerances on the dimensions of conventional envelopes often have a wide degree of variability from batch to batch, necessitating frequent adjustments of set-ups of the inserting apparatus. Unfortunately, present inserter systems often cause the envelope to get snagged, stuck or jammed before the insertion process is complete.

A stack of material, such as paper, stationary, printed material or other paper-based product can be stored in a tray or other support apparatus. An efficient way to print and/or feed the material is by positioning the material such that a long edge is fed from a device, such as a printer, first. This long edge first configuration enhances the speed of the output of the material from the tray.

The present invention is an enclosure and method and apparatus for fabricating an enclosure that can be mailed or delivered to a recipient. The enclosure may have content information printed on an inside surface and recipient information, sender information and postal indicia printed on an outside surface. The enclosure may be used to enclose additional content material as an alternative to inserting the content material into the enclosure. As described herein, typically insertion, inserting and other forms of the term, denote positioning materials inside an enclosure after the enclosure has been formed. Enfolding and other forms of the term denote positioning materials on an enclosure sheet before or while the enclosure is formed.

As described herein, creased means providing a linear indenture on the sheet to facilitate future folding along the line of the crease. Folded means positioning the surface of a first portion of a sheet or a set of sheets adjacent to a surface of a second portion of the sheet or set of sheets and pressing the two portions flat against each other.

The enclosure apparatus and method will enclose content material with varying thickness inside the enclosure that is fabricated from a standard sized sheet of paper. An advantage of this is that the paper that is used as the enclosure is the same size as the contents prior to folding the contents. This eliminates the need to have separate envelopes fed into an inserter or printer. A preferred size paper for use in this invention is one commonly available in offices, such multipurpose stock paper including standard sized paper, which is, for example letter size (8.5 inches by 11 inches), A4, B4, legal or folio. Although the above-listed paper sizes are standard, it should be apparent that other sizes of paper could also be used with the present invention.

The present method utilizes a same sized sheet that is folded in such a way as to receive content material in an insertion, enfolding and/or enclosing process. The method is typically used in conjunction with a printer attached in-line to an inserter, enfolding and/or enclosing system or could include printed material that is loaded manually into feed trays of an off-line inserter system or material from a roll of preprinted material (which may include both enfolding sheets and content sheets) which are then cut to size and advanced into an enfolding and/or enclosing system.

Figure 2:
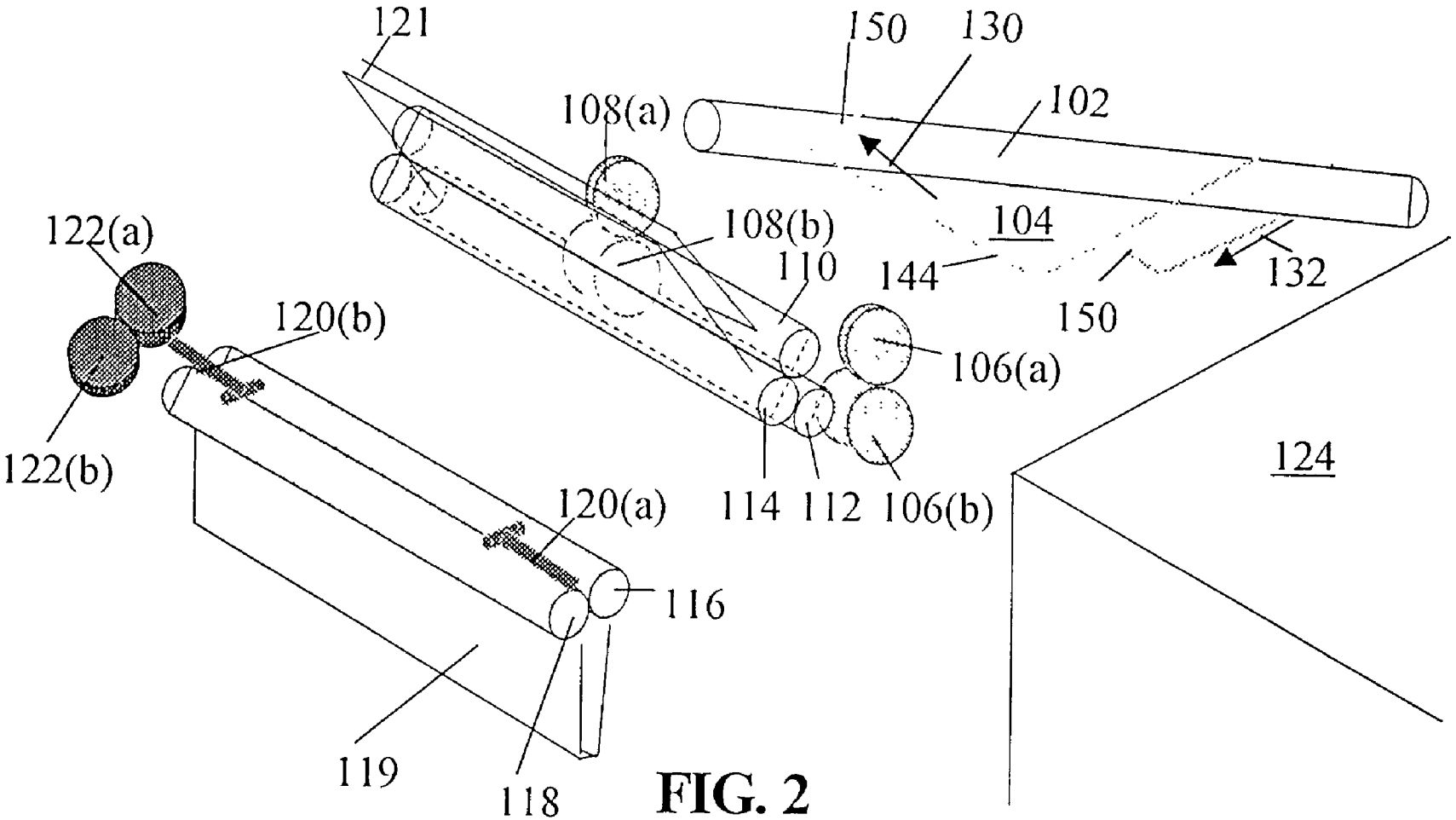
Figure 3:
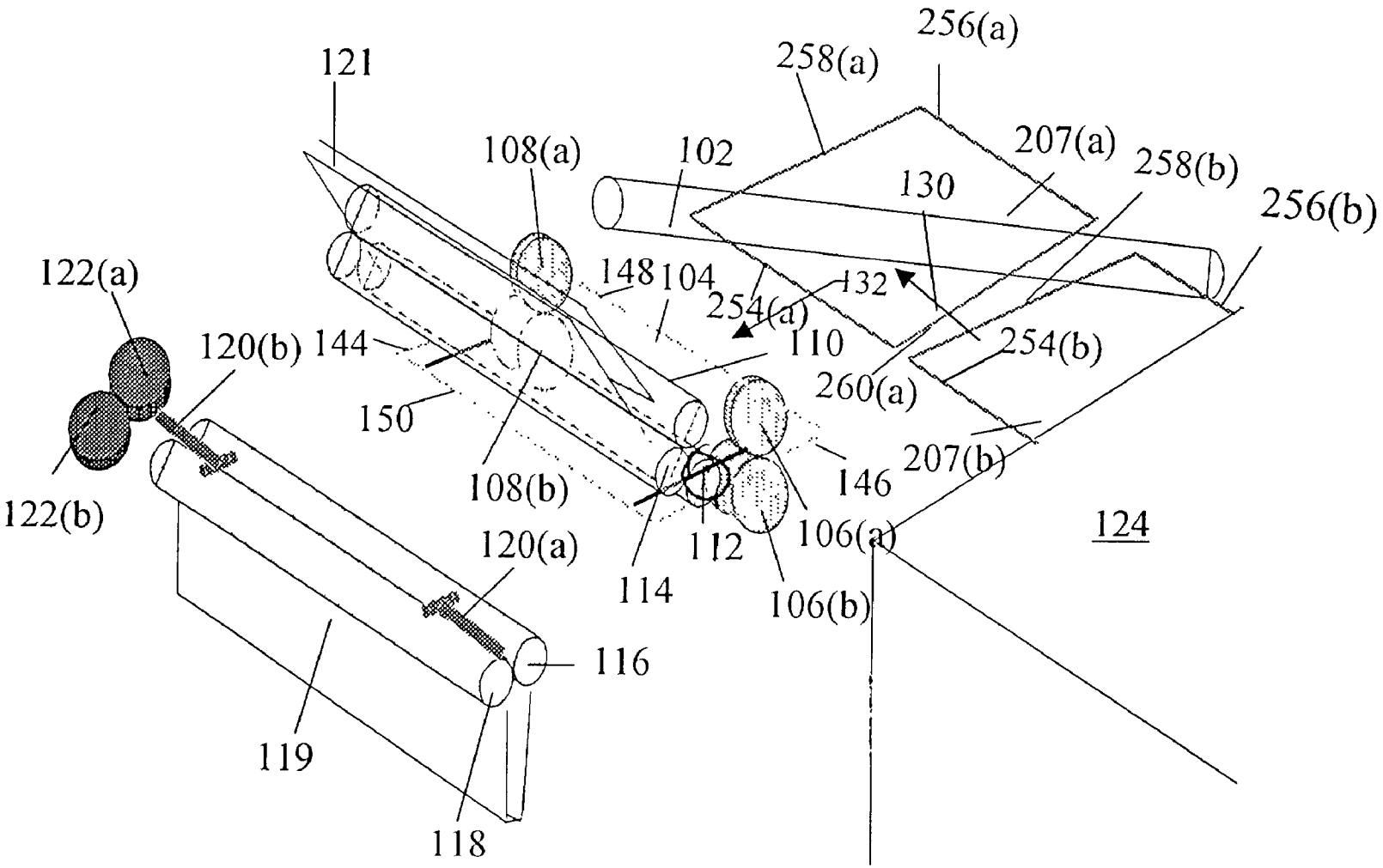

As shown in FIG. 1, the system includes a printer, photocopier or paper storage device 124 that has a tray or stack or roll of paper or other material. Storage device 124 may be coupled to a computer, memory or processing device. The system illustrated in FIGS. 1–9 may be used with conveyor belts or other paper or material handling devices. A first sheet of material 104, which is typically paper, is fed, as shown by line 130, to inverter roller 102. Sheet material 104 has a leading long edge 150, trailing long edge 148 (not shown) and short edges 144 and 146. Inverter roller 102 causes the sheet material 104 to invert and change direction of motion (as shown in FIG. 2). Creasing rollers 106(*a*) and 106(*b*) and 108(*a*) and 108(*b*) receive and crease sheet material 104 as shown by line 132 (as shown in FIG. 3). Sheet 104 moves beneath folding rollers 110, 112, and 114 and is not engaged by them. Sheet material 104 is fed to rollers 116 and 118 as shown by line 134. As shown by lines 136 and 140, sheet material 104 is pushed through rollers 116 and 118 to receiving bin 119, by folding arms 120(*a*) and 120(*b*). Sealing rollers 122(*a*) and 122(*b*) receive sheet material 104 as shown by line 138. Sealing rollers 122(*a*) and 122(*b*) seal portions of sheet material 104 to produce an enclosure.

The description of FIG. 1 relates generally to a system for creating an enclosure that does not include additional content material. As shown in FIG. 1, sheet material 104 has opposed parallel long edges 148 and 150 and opposed parallel short edges 144 and 146 (long edge 148 not shown in FIG. 1). The long edges 148 and 150 are, for example, approximately 11 inches long for an 8½ by 11 inch sheet of paper. The short edges, 144 and 146, are, for example, approximately 8½ inches long.

As shown in FIG. 2, sheet material 104 is fed to inverter roller 102. Inverter roller 102 causes sheet material 104 to be inverted and its direction of motion changed, so that long edge 150 of sheet material 104 changes direction of motion from 130 to 132, and then is advanced to creasing rollers 106(*a*) and 106(*b*) and 108(*a*) and 108(*b*). Sheet material 104 proceeds in the same manner as described in FIG. 1. The other elements of FIG. 2 have been described in relation to FIG. 1, and will not be discussed in relation to FIG. 2. Thus, sheet material 104 is dispensed, or output, from device 124 long edge first. Inverter roller 102 inverts sheet material 104 and changes the direction of travel. Sheet material 104 is still moving long edge first but is traveling in a direction perpendicular to the path it was traveling when it exited device 124.

As shown in FIG. 3, leading long edge 150 of sheet material 104 is fed through creasing rollers 106(*a*) and 106(*b*) and 108(*a*) and 108(*b*). Creasing rollers 106, and 108, crease along short edges 144 and 146 of sheet material 104 (sheet 104 passes below and does not engage fold rollers 110, 112, and 114). A plurality of content material, shown generally as 207(*a*) and 207(*b*), is fed to a position above inverter roller 102 and is not engaged by inverter roller 102. Content material 207(*a*) has a leading long edge 258(*a*), trailing long edge 260(*a*), and opposing short edges 254(*a*) and 256(*a*). Content material 207(*a*) moves into a compiling station above roller 102 in direction 130 and stops with short edge 254 parallel to folding rollers 110, 112, and 114. Content material 207(*b*) has leading long edge 258(*b*) and opposing short edges 256(*b*) and 254(*b*) and moves in direction 130 to a position atop content material 207(*a*). The other elements shown in FIG. 3 have been discussed above, and are not discussed in relation to FIG. 3.

Figure 4:
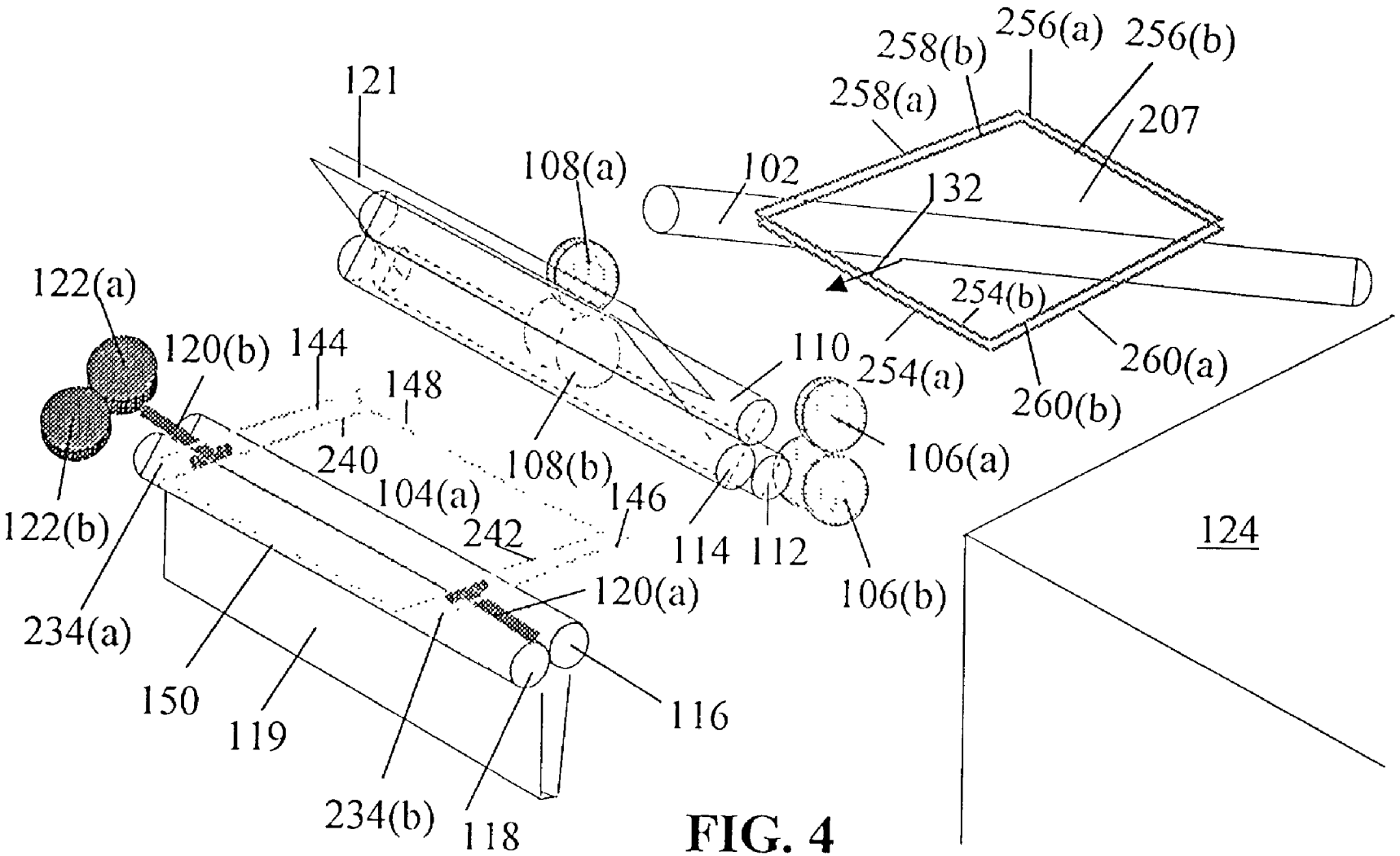

As shown in FIG. 4, sheet material 104 with creases 240 and 242 has advanced to a position above rollers 116 and 118. Creases 240 and 242 have created surfaces 234(*a*) and 234(*b*), respectively. At the same time, content material 207 is shown compiled and will be moved short edges 254(*a*) and 254(*b*) first in direction 132, which is generally perpendicular to the infeed direction into the compiler 130 to be fed to rollers 110, 112, and 114. The other elements shown in FIG. 4 have been discussed above, and are not discussed in relation to FIG. 4.

Figure 5:
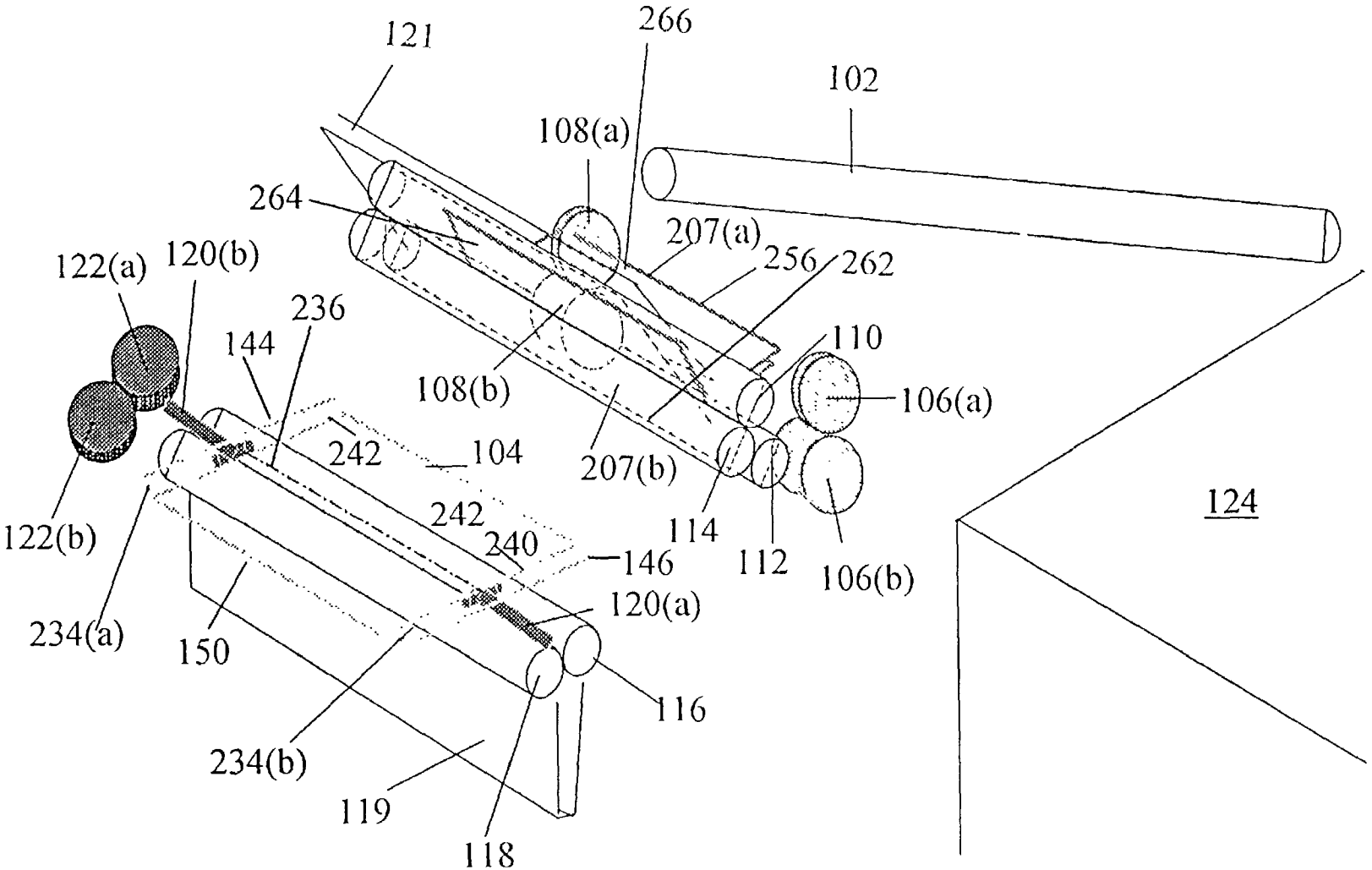

As shown in FIG. 5, folding rollers 110, 112, and 114 fold content material 207. Content material 207 is folded at a position that is approximately one third of the length of the long edge of the material to form crease 262, that creates fold-over portion 264. (This is seen more clearly in FIG. 6). Unfolded area 266 is approximately two-thirds the length of long-edges. Trailing short edge 256 of material 207 is also shown. Sheet material 104 is moved so that midpoint 236 is positioned approximately over the area between rollers 116 and 118.

Figure 6:
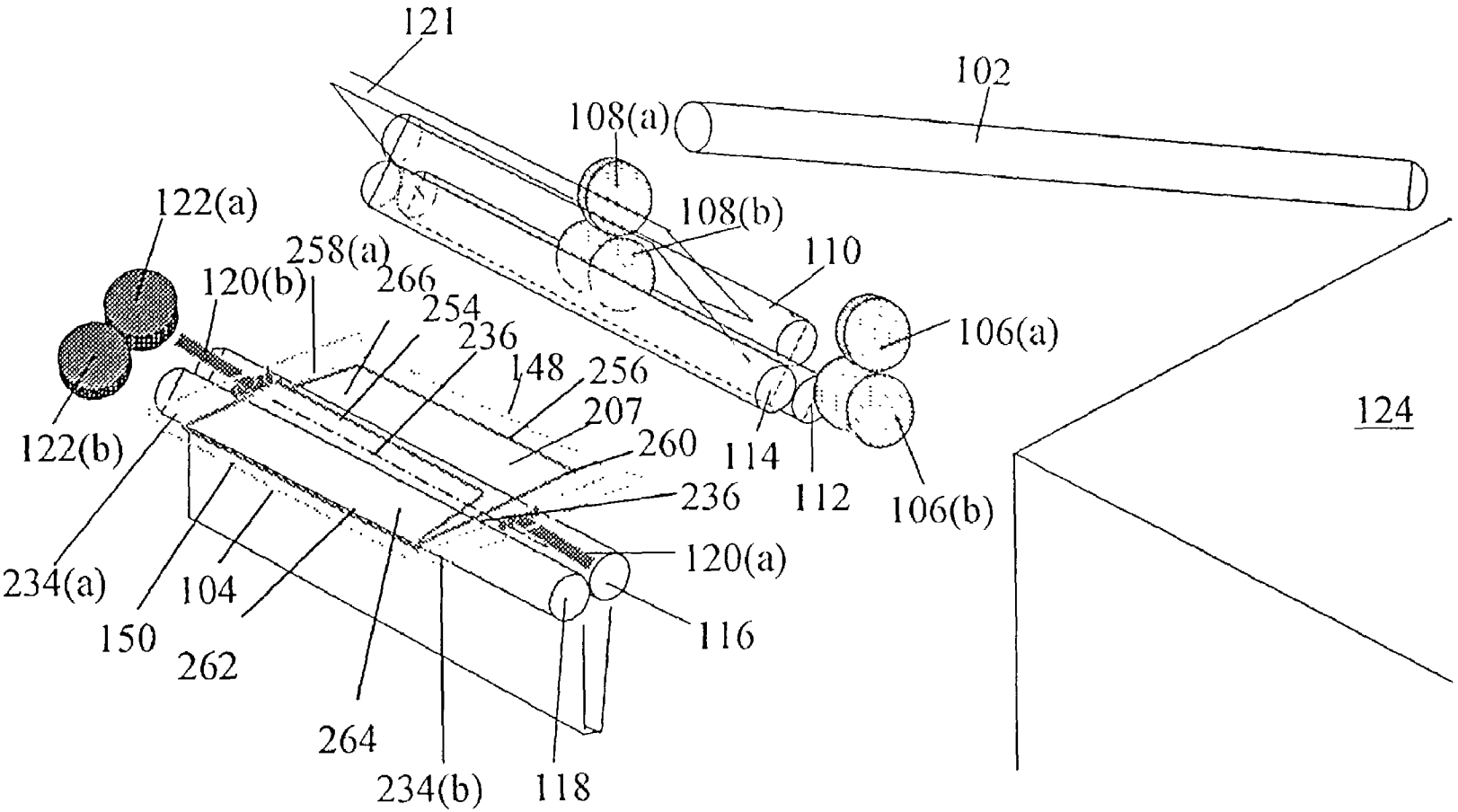

As shown in FIG. 6, content material 207 is positioned on sheet material 104 so that approximately half of unfolded area 266 lies to one side of midpoint 236 of sheet material 104 and approximately half of 266 lies to the other side of midpoint 236. The content material 207 is positioned so that long edges 258 and 260 are within the mid portion of sheet material 104. These edges are approximately between 0.125 and 0.75 inches from portions 234(*a*) and 234(*b*). Mid-section line 268 and unfolded area 266 is approximately on top of sheet material 104 mid-section 236. Trailing edge 256 of content material 207 is approximately between 0.5 and 2.0 inches from long edge 148 of sheet 104. Folded edge 262 is similarly approximately between 0.5 and 2.0 inches from long edge 150 of sheet 104.

Figure 7:
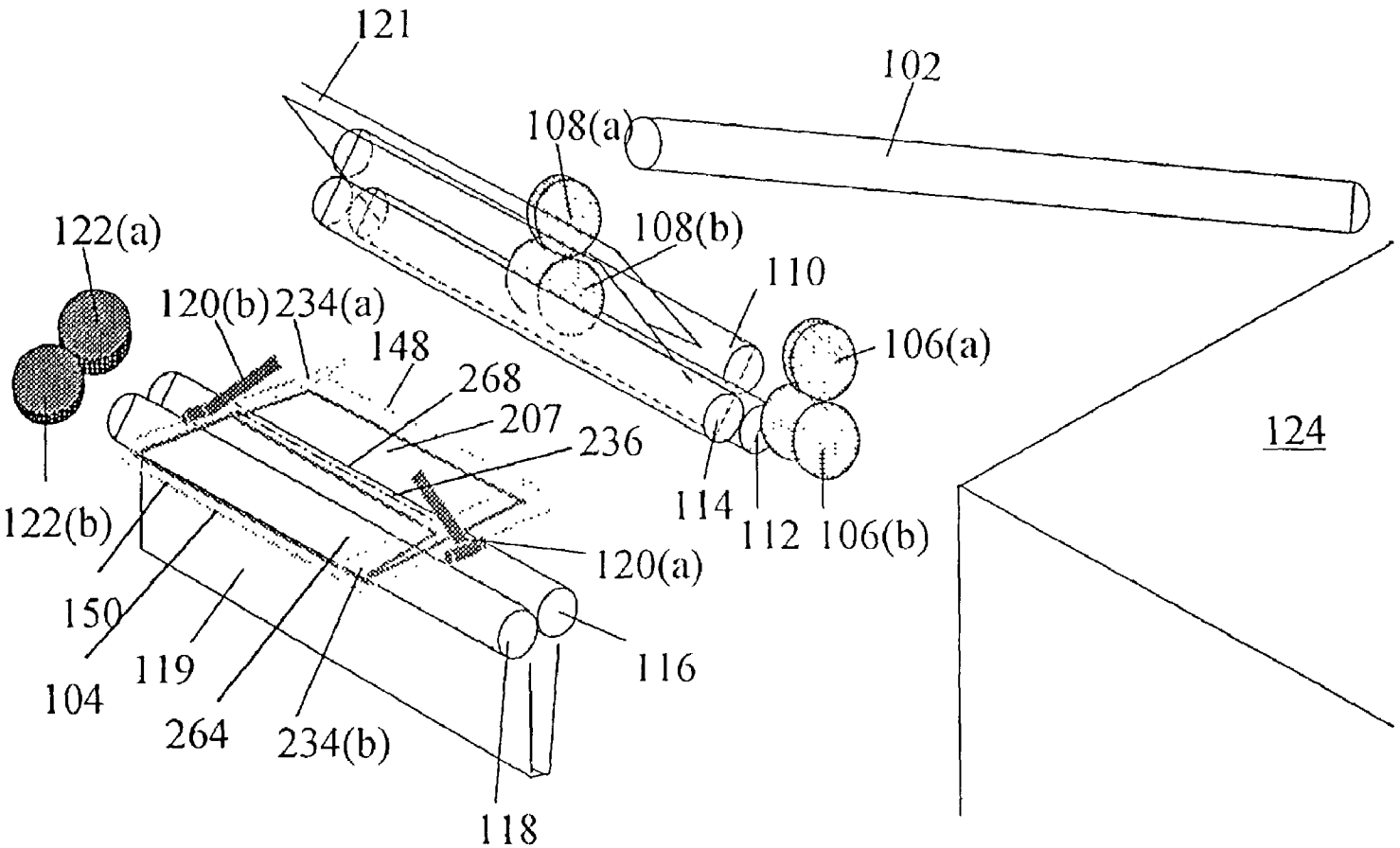

As shown in FIG. 7, folding arms 120(*a*) and 120(*b*) fold panels 234(*a*) and 234(*b*) onto content material 207. The folding arms 120(*a*) and 120(*b*) also facilitate inducing the sheet material 104 along mid-section 236 and content material 207 along mid-section 268 into the folding nip formed by rollers 116 and 118.

Figure 8:
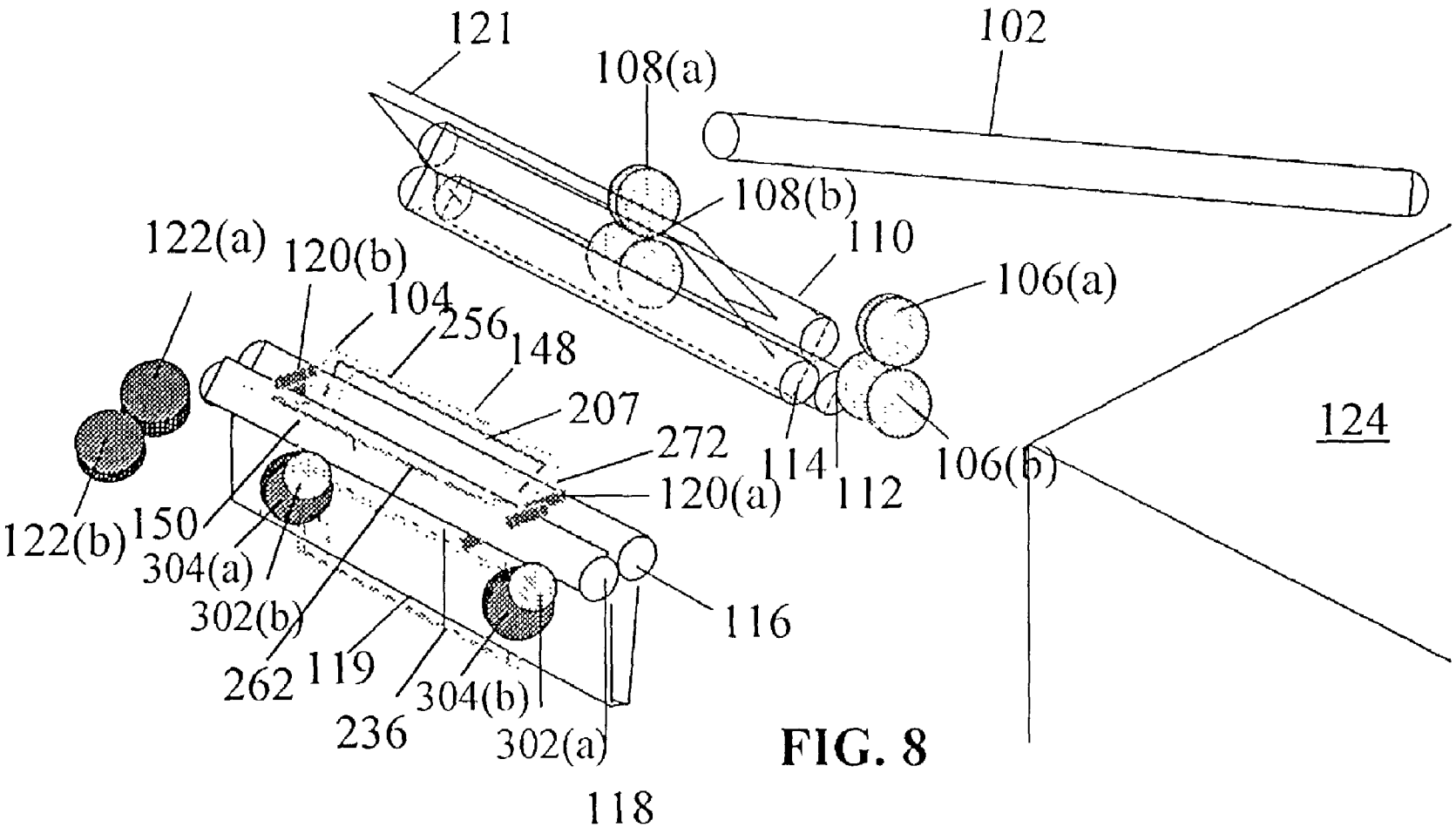

FIG. 8 shows that the content material 207 is enfolded in sheet material 104 as folding rollers 116 and 118 fold the content material and sheet material. Material edges 148 and 150 approach each other. Content edges 262 and 256 also approach each other. The enclosure 292 is directed to holding bin 119. Enclosure 292 is fed to sealing rollers 302(*a*) and 302(*b*), which seal the enclosure along the short edges to form sealed portions 278 and 282. Although only two rollers 302(*a*) and 302(*b*) are shown, each roller works in conjunction with another roller (not shown) to perform the sealing operation. Alternatively, for other sealing procedures, the appropriate apparatus could be interchanged for the rollers shown in FIG. 8. The other elements shown in FIG. 8 have been discussed above, and are not discussed in relation to FIG. 8.

Figure 9:
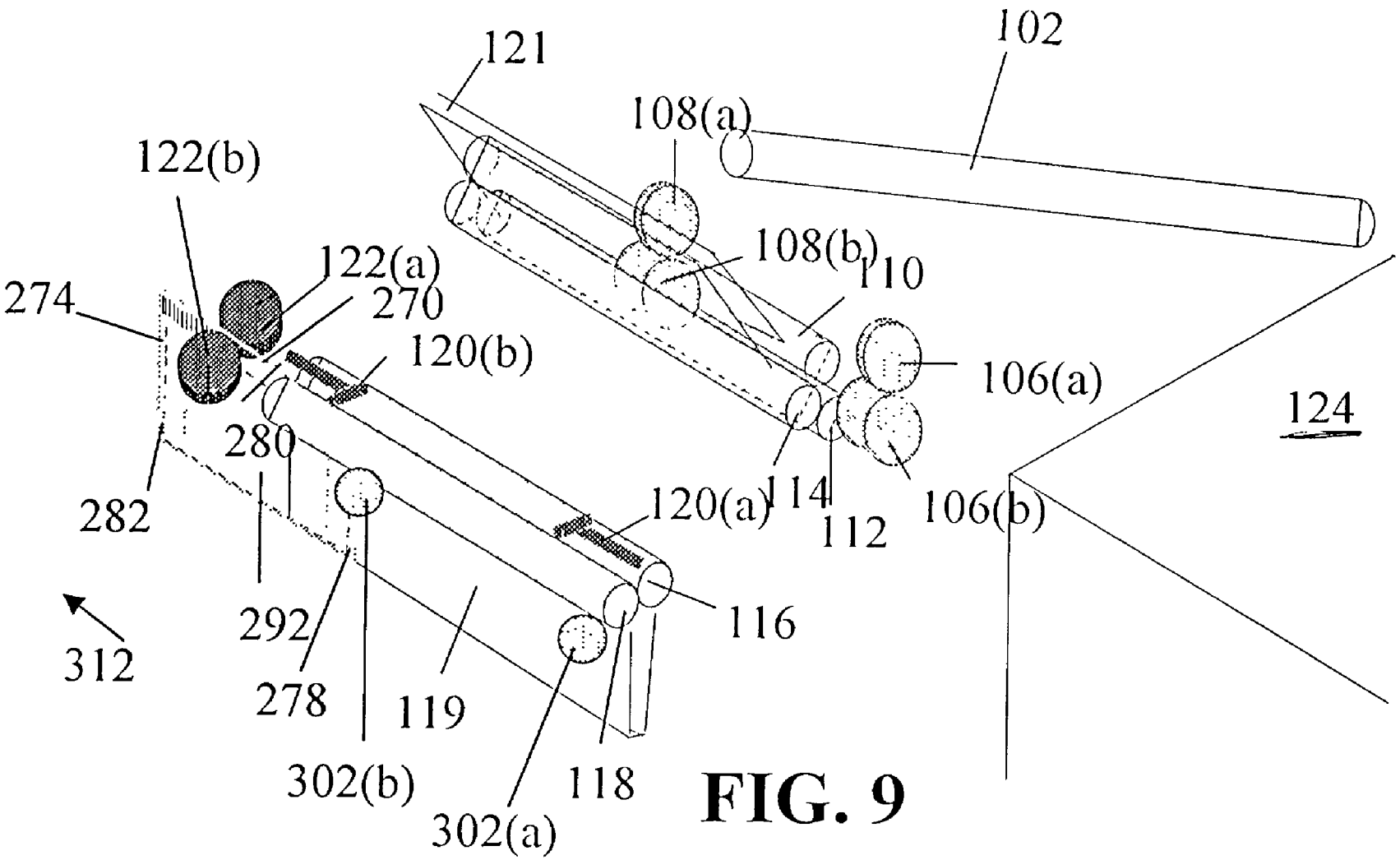

FIG. 9 shows sheet material 104 and content material 207 have been folded to form enclosure 292. Sealing rollers 122(*a*) and 122(*b*) seal edge 270 to edge 280 to seal enclosure 292.

The enclosure then moves in direction 312 to seal edges 270 and 280 to each other as enclosure 292 moves through sealing rollers 122(*a*) and 122(*b*).

As is apparent to one skilled in the art, additional sealing device (not shown) could be used to seal short edges of enclosure 292. The sealing along the short edges 274 and 272 is shown by lines 282 and 278, respectively.

Other material such as business reply envelopes, cards, postcards and the like may be added to the content material 207 prior to the folding operation described above.

Alternatively, content material 207 may be placed on sheet material 104 before the opposing edge portions 144 and 146 have been creased.

Alternatively, creasing rollers 106(*a*) and 108(*a*) could be replaced by perforating rollers. In this embodiment, arms 120(*a*) and 120(*b*) are positioned slightly further apart so that panels 234(*a*) and 234(*b*) are not folded on top of content material 270 as the arms 120(*a*) and 120(*b*) induce the material into fold rollers 116 and 118.

The sealing devices 122 and 302 are used to seal portions of the folded material. For example, sealing device 122 may attach the material along edge portion as described herein. Sealing devices 122 and 302 may seal along selected surface portions such as the long edges, short edges, or any combination thereof. The sealing can be via knurling, crimping, embossing, gluing, pressure sensitive adhesive, hot-melt material, stapling, tabbing, double-back adhesive tape and other attaching mechanisms to affix portions of the sheet material 104. As stated above, the sealing means, although shown as rollers 122 and 302 may be any suitable apparatus. For example, in an embodiment in which the edges of the enclosure are glued, the sealing means apply an adhesive and pressure to seal desired portions of the enclosure 292. Other sealing techniques may require specific sealing apparatus to carry out the desired sealing technique.

Once the enclosure 292 is formed, an exterior portion is available to print destination address information, sender address information and indicia information. A printing device, which may be a standard printer connected to a computer (computer not shown) or a networked printer that is authorized to print postal indicia may be used. The printer may be for example connected to postage by phone technology available from Pitney Bowes, or other mechanism to permit postal indicia to be printed as well as destination address, sender address and slogan information. It should be apparent that the use of the printer is optional.

Alternatively, the above-mentioned information can be printed on the sheet material prior to the folding operation. Thus, when the enclosure is formed, the information is present on an exterior surface thereof.

In an alternative embodiment, content material 207 may be manually inserted into the sheet material after the sheet material has been folded to produce the enclosure. Thus, a user at a personal computer user can print a letter, fold the letter and manually insert the letter into the enclosure, or place the content material on the sheet material at any time prior to the sealing operation of sealing mechanism 122.

It will also be apparent to those skilled in the art that alternate sealing methods can be used. For example the leading edge and/or long-edge of enclosure 292 may contain an adhesive that is moistened and then folded to contact a corresponding edge and thereby form an adhesive bond between the two surfaces. Alternatively an adhesive that is heated and pressed may be used to seal the edge. In a similar fashion, portions 234(*a*) and 234(*b*) may have a pressure sensitive adhesive that is sealed when the mailer is fed through sealing device 122. Still another alternative is to crimp the edges as discussed above.

It should be apparent that the invention as described herein can utilize content material that comprises different sized material. For example, a letter sized piece of paper and a postcard may be folded and inserted or enfolded into the enclosure material.

It should be apparent that the invention as described herein may use various apparatus to produce the enclosure and the content material. For example, a means for folding a material along a first edge and a second edge may be rollers, creasing devices, folding devices or the like, positioned so that the material is creased or folded at desired points. Similarly, the means for folding the material along a mid-section may be, for example, a roller, a device that presses impressions, and other devices capable of producing folds or creases at the desired points.

It should also be apparent to one skilled in the art that conventional means of rollers, belts, vacuum devices can be applied to transport the material in the various directions described herein.

The means for attaching two portions of the enclosure material together that are formed by creasing the enclosure material along the mid-section may be for example, an adhesive tab that is peeled from a backing, an adhesive material, such as tape or glue, an adhesive tape with release paper, double-sided adhesive tape, staples, knurling, embossing, crimping, hot melt and pressure sensitive adhesive.

It is to be understood that the present invention is not to be considered as limited to the specific embodiments described above and shown in the accompanying drawings, which merely illustrate the best mode presently contemplated for carrying out the invention, and which is susceptible to such changes as may be obvious to one skilled in the art, but rather that the invention is intended to cover all such variations, modifications and equivalents thereof as may be deemed to be within the scope of the claims appended hereto.

What is claimed is:

1. A method for fabricating an enclosure, comprising the steps of:

providing a first sheet of material from a plurality of sheets of material the plurality of sheets being positioned in a pre-determined orientation;

varying the direction of the first sheet of material a pre-determined magnitude;

creasing the first sheet of material along two-short edges of the first sheet;

generating content material;

compiling the content material;

folding the content material at a pre-determined area of the content material;

positioning the content material on the first sheet;

folding the content material and the first sheet at a pre-determined location so that two opposing long edges of the first sheet make contact;

sealing a portion of the first sheet along the two opposing long edges of the first sheet; and sealing a portion of the first sheet of material along at least one short edge of the first sheet.

2. The method as claimed in claim 1, further comprising the step of: printing an indicia on an exterior surface of the first sheet.

3. The method as claimed in claim 1, further comprising the step of: retrieving recipient address data from a memory.

4. The method as claimed in claim 3, further comprising the step of: printing the recipient address data on the first sheet.

5. The method as claimed in claim 1, wherein the sealing step comprises crimping the long edges of the first sheet that are in contact with one-another.

6. The method as claimed in claim 1, wherein the step of folding the content material at a predetermined area further comprises folding the content material approximately one-third of the length of the content material.

7. The method as claimed in claim 1, wherein the step of folding the content material and the first sheet at a predetermined location further comprises folding the content material and the first sheet at a position approximately one-half the length of the short edge of the first sheet.

8. The method as claimed in claim 1, further comprising the step of:

feeding the first sheet along the predetermined path such that the first sheet is positioned in a pre-determined manner.

9. The method as claimed in claim 1, further comprising the step of:

positioning the content material such that content data is facing a predetermined direction.

10. The method as claimed in claim 1, further comprising the step of: printing sender address data on the first sheet.

11. The method as claimed in claim 1, further comprising the step of: printing recipient address data on the first sheet.

12. The method as claimed in claim 1, further comprising the step of: printing additional information on the first sheet.

13. The method as claimed in claim 1, wherein: the crease of the first sheet is approximately between 0.125 to 1.5 inches from the short edge of the first sheet.

14. The method as claimed in claim 1, wherein the content material is fabricated from standard sized paper.

15. The method as claimed in claim 1, wherein the first sheet is a standard size sheet of paper.

16. The method as claimed in claim 1, wherein the first sheet and the content material are the same size.

17. The method as claimed in claim 1 further comprising the step of:

processing the content material prior to positioning the content material on the first sheet.

18. The method as claimed in claim 1, wherein the sealing a portion of the first sheet along the two opposing long edges of the first sheet further comprises knurling at least a portion of the two opposing long edges of the first sheet.

19. The method as claimed in claim 1, wherein the sealing a portion of the first sheet along the short edge of the first sheet further comprises knurling at least a portion of the short edge of the first sheet.

20. The method as claimed in claim 1, wherein the sealing a portion of the first sheet along the two opposing long edges of the first sheet further comprises crimping at least a portion of the two opposing long edges of the first sheet.

21. The method as claimed in claim 1, wherein the sealing a portion of the first sheet along the short edge of the first sheet further comprises crimping at least a portion of the short edge of the first sheet.

22. The method as claimed in claim 1, wherein the sealing a portion of the first sheet along the two opposing long edges of the first sheet is achieved by using an adhesive.

23. The method as claimed in claim 1, wherein the sealing a portion of the first sheet along the short edge of the first sheet is achieved by using an adhesive.

24. The method as claimed in claim 1, wherein the sealing a portion of the first sheet along the two opposing long edges of the first sheet is achieved by embossing.

25. The method as claimed in claim 1, wherein the sealing a portion of the first sheet along the short edge of the first sheet is achieved by embossing.

26. The method as claimed in claim 1, wherein the sealing a portion of the first sheet along the two opposing long edges of the first sheet is achieved by stapling.

27. The method as claimed in claim 1, wherein the sealing a portion of the first sheet along the short edge of the first sheet is achieved by stapling.

28. The method as claimed in claim 1, wherein the sealing a portion of the first sheet along the two opposing long edges of the first sheet is achieved by tabbing.

29. The method as claimed in claim 1, wherein the sealing a portion of the first sheet along the short edge of the first sheet is achieved by tabbing.

30. The method as claimed in claim 1, wherein the sealing a portion of the first sheet along the two opposing long edges of the first sheet is achieved by double sided tape.

31. The method as claimed in claim 1, wherein the sealing a portion of the first sheet along the short edge of the first sheet is achieved by double sided tape.

32. The method as claimed in claim 1, wherein the sealing a portion of the first sheet along the two opposing long edges of the first sheet is achieved by applying pressure to a pressure sensitive adhesive.

33. The method as claimed in claim 1, wherein the sealing a portion of the first sheet along the short edge of the first sheet is achieved by applying pressure to a pressure sensitive adhesive.

34. The method as claimed in claim 1, wherein sealing a portion of the first sheet along the two opposing long edges of the first sheet is achieved by activating a hot melt material.

35. The method as claimed in claim 1, wherein the sealing a portion of the first sheet along the short edge of the first sheet is achieved by activating a hot melt material.

36. The method as claimed in claim 1, further comprising the step of:

perforating at least one portion of the first sheet.

37. The method as claimed in claim 36, further comprising the step of:

sealing a portion of the first sheet of material along the short edge of the first sheet.

* * * * *